United States Patent [19]

Heesemann

[11] Patent Number: 4,839,994

[45] Date of Patent: Jun. 20, 1989

[54] BELT GRINDING MACHINE

[75] Inventor: Juergen Heesemann, Bad Oeynhausen, Fed. Rep. of Germany

[73] Assignee: Karl Heesemann Maschinenfabrik GmbH & Co. KG, Bad Oeynhausen, Fed. Rep. of Germany

[21] Appl. No.: 121,852

[22] Filed: Nov. 17, 1987

[30] Foreign Application Priority Data

Nov. 18, 1986 [DE] Fed. Rep. of Germany ..... 3639329

[51] Int. Cl.[4] ..... B24B 21/00

[52] U.S. Cl. ..... 51/165.72; 51/138; 51/141; 356/376

[58] Field of Search ..... 51/137, 138, 139, 141, 51/165.72; 356/376, 371

[56] References Cited

U.S. PATENT DOCUMENTS

| | | | |
|---|---|---|---|
| 4,188,544 | 2/1980 | Chasson | 356/376 |
| 4,425,041 | 1/1984 | Nishiyama | 356/371 |
| 4,498,778 | 2/1985 | White | 356/376 |
| 4,601,134 | 8/1986 | Hessemann | 51/138 |
| 4,741,621 | 5/1988 | Taft et al. | 356/376 |

FOREIGN PATENT DOCUMENTS 3402104 8/1985 Fed. Rep. of Germany .

*Primary Examiner*—Bruce Y. Arnold
*Assistant Examiner*—Jay Ryan
*Attorney, Agent, or Firm*—Foley & Lardner, Schwartz, Jeffery, Schwaab, Mack, Blumenthal & Evans

[57] ABSTRACT

A belt grinding machine is disclosed that includes a pressure bar which has a plurality of pressure shoes arranged next to one another transversely relative to the conveying direction of the workpiece to be machined, and in which each pressure shoe has assigned to it its own pressing-on device actuable as a function of workpiece parameters, the pressing on force of the pressing-on device being controlled by means of a signal-processing unit taking into account the workpiece parameters and local and time data of the workpiece transport operation. A simple and comprehensive detection of workpiece parameters is carried out with the use of a light source which illuminates the surface of the workpiece linearly transversely relative to the conveying direction. The light source is arranged in front of or behind the light incidence point in the conveying direction, and a light sensor senses a surface region comprising a portion of the transverse direction and a portion in the conveying direction in order to detect workpiece parameter.

18 Claims, 7 Drawing Sheets

BELT GRINDING MACHINE

BACKGROUND OF THE INVENTION

The invention relates to a belt grinding machine with a pressure bar which has a plurality of pressure shoes arranged next to one another transversely relative to the conveying direction of the work-piece to be machined, and in which each pressure shoe has assigned to it its own pressing-on device actuable as a function of workpiece parameters, the pressing-on force of the pressing-on device being controlled by means of a signal-processing unit taking into account the workpiece parameters and local and time data of the workpiece transport operation.

A belt grinding machine of this type is known from German Patent Specification 3,402,104. It affords the advantage that the pressing-on force of the individual pressure shoes can be regulated individually as a function of the workpiece shape. This presupposes a sheet-like workpiece, its shape being determined by the outer limitation of the sheet-like workpiece. The purpose of regulating the pressing-on force is to prevent excessive grinding of the edges of the workpiece. After the workpiece shape has been detected, the appropriate pressure shoes located in the region of the edge are pressed against the workpiece with a decreasing pressing-on force from the center of the workpiece towards the edge, so that the undesirable round grinding of the edges is effectively prevented. The known belt grinding machine is also capable of taking into account variations in thickness of different workpieces at the same machine setting. For this, upstream of the sensing rollers for the workpiece shape detection, a thickness measuring device is arranged which measures the thickness of the workpiece at one place, so that the thickness of the workpiece can be taken into account by the pressing-on force control.

SUMMARY OF THE INVENTION

The object of the present invention is to provide a belt grinding machine of a kind in which workpiece detection is possible with a simple device that allows warping and other irregularities to be detected.

According to the invention, this object is achieved with a light source for detecting workpiece parameters that illuminates the surface of the workpiece linearly transversely relative to the conveying direction, the light source is arranged in front of or behind the light incidence point in the conveying direction, and there is a light sensor which senses a surface region comprising a portion in the transverse direction and a portion in the conveying direction.

The belt grinding machine according to the invention makes it possible not only to detect in a simple way the contour form of the workpiece, but also to detect both the thickness and the surface form at the same time. Through the projection of a linear light mark transversely relative to the conveying direction by means of a light source which is arranged in front of or behind the incidence point, height differences on the surface of the workpiece lead to corresponding displacements in the conveying direction. The light generated in linear form of a light source arranged behind the incidence point in the conveying direction strikes the workpiece earlier than on the transport plane, so that the transverse line on the surface of the workpiece is imaged behind the transverse line on the conveying plane of the conveyor belt in the conveying direction. If the surface of the workpiece has a dish-shaped warp, the light line obtained is bent from the rear forwards from the higher edges of the workpiece to the deepest depression. In a similar way, taping paper glued to the surface or another step-like change in height results in a corresponding offset of the light line pointing to the rear. By means of the light sensor, the position of the light line in the conveying direction is measured and assigned to a local height of the workpiece by means of the signal-processing unit. Thus, warping of the workpiece, surface irregularities, etc. can be detected immediately and taken into account in the grinding operation.

The light from the light source can be of linear form so that the linear light strip is generated continuously on the workpiece or on the conveying plane. In an alternative embodiment, it is also possible to cause a single light beam to oscillate at high frequency, so that a constantly illuminated light strip is obtained.

The light sensor is preferably formed by a semiconductor camera which, via an optical system, images the region to be sensed. At the same time, the semiconductor camera can be a so-called linear camera, in which the photosensitive elements are arranged linearly. For sensing the region, a movement of the image essentially perpendicularly relative to the extension of the photosensitive elements is caused by means of a mechanism. An electronic scan is made along the photosensitive elements arranged linearly, and the image, offset a certain distance each time, is sensed once again along the photosensitive elements in the direction perpendicular to these. At the same time, it is advantageous if the electronic scan via the photosensitive elements is carried out in the conveying direction and the mechanical movement results in a scan transversely relative to the conveying direction. At the same time, the mechanical movement is preferably produced as a result of the movement of a deflecting mirror.

The mechanical movement can be omitted completely if the photosensitive elements of the semiconductor camera are in a two-dimensional arrangement, that is to say as in a conventional television camera. In this embodiment, it is extremely advantageous if the image of the region to be sensed is stretched on the surface of the semiconductor camera in the conveying direction. This can be effected by means of a cylindrical lens or a cylindrical deflecting mirror. The stretching of the region to be sensed, taking place in the conveying direction, results in an enhanced resolution in this direction. Since the surface height is detected in this direction, the stretching in this direction is especially advantageous for the workpiece detection according to the invention.

The arrangement according to the invention can advantageously be used also to detect directly a marking of the type of material, for example the type of wood, made on the workpiece. For this, there is a detection means for signal patterns which are obtained as a result of the sensing of a bar code, applied to the workpiece and extending transversely relative to the conveying direction, by the image sensor. If a bar code is stamped on the workpiece, preferably at the leading end, this bar code is detected in terms of its light/dark distribution during linear illumination and scanning and can be used accordingly to regulate the pressure bar. The fact that different surface materials require different grinding pressures can thus be taken into account.

In a further especially advantageous embodiment of the invention, there is a detection means for brightness signals of an intensity greatly different from that of the environment. With a detection means of this type, it is possible, for example, to detect taping paper during the sensing of the linear illumination. This applies, at least, when the taping paper has a high contrast relative to the surface of the veneer. If appropriate, this effect can be obtained by using special taping paper, such as reflecting taping paper, dyed taping paper or taping paper saturated with a fluorescent substance. It is thus possible to ensure that the taping paper which is very difficult to grind off in the conventional technique is subjected to an increased pressure, so that it is possible to remove the taping paper reliably.

BRIEF DESCRIPTION OF THE DRAWINGS

The invention will be explained in detail below with reference to exemplary embodiments illustrated in the drawings in which.

DETAILED DESCRIPTION OF THE PREFERRED EMBODIMENTS

Figure 1:
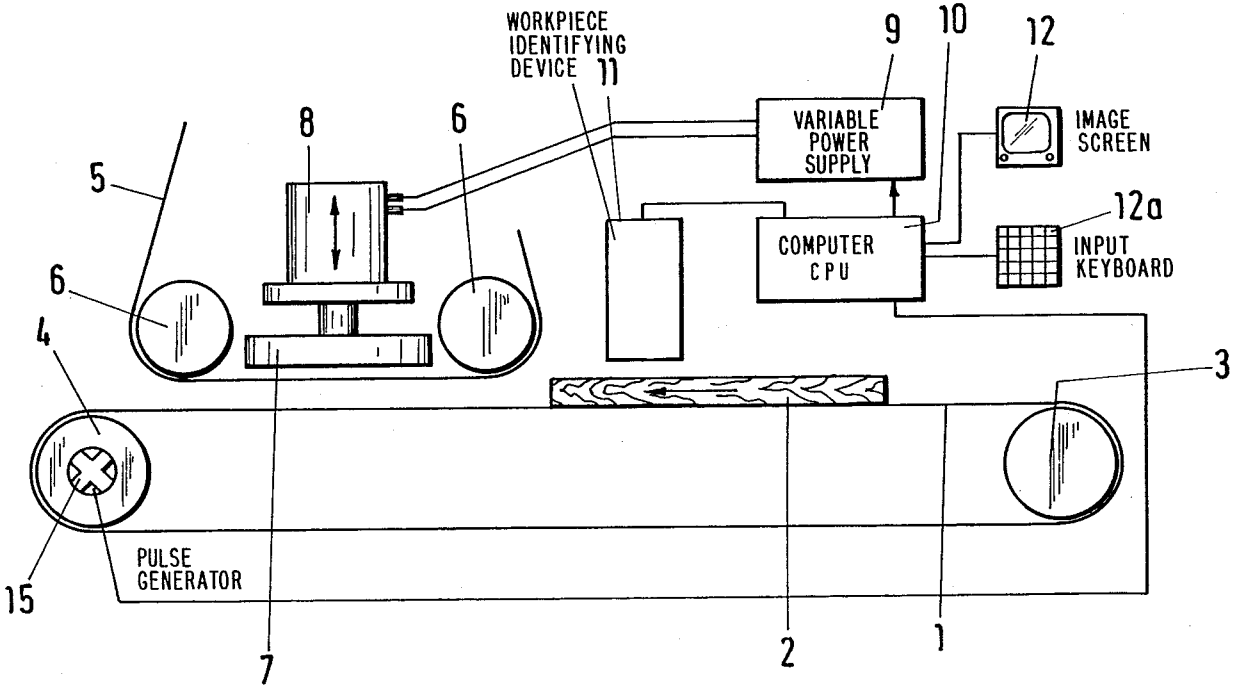
FIG. 1 shows a diagrammatic lateral representation of a wide-belt grinding machine.

Referring now to FIG. 1, a conveyor belt 1 for workpieces 2 is shown. The conveyor belt 1 runs between two deflecting rollers 3,4, one of which is driven. To carry out the desired surface machining, the workpiece 2 runs through on the conveyor belt 1 under a grinding belt 5 which is designed as an endless belt and which is guided round at least three deflecting rollers 6 (the upper deflecting roller is not shown in the drawing). Two of the deflecting rollers 6 are aligned parallel to the upper face of the conveyor belt 1, so that the grinding belt 5 extends parallel to the upper face of the conveyor belt 1 between the two rollers 6 (grinding zone). The grinding belt 5 is pressed against the workpiece 2, between the two above-mentioned deflecting rollers 6, by means of a pressure bar 13 formed from several pressure shoes 7. The pressing force of each pressure shoe 7 is adjusted by means of a pressing-on device 8 formed from a solenoid, the exciting current of the Solenoid being set, via a voltage supply 9, by means of a computer 10 forming a signal-processing unit. The computer 10 is connected to a workpiece detection device 11 which detects the presence of a workpiece part in the region of the particular pressure shoe 7 and further parameters of the workpiece 2 and which transmits this information to the computer 10. Also connected to the computer 10 is an input keyboard 12a, by means of which, for example, the amount of grinding pressure for full-surface grinding can be entered for the specific workpiece 2. The data entered in the computer 10 can be displayed on a video screen 12 likewise connected to the computer 10. Since the workpiece 2 takes a certain transport time to pass between the workpiece detection device 11 and the pressure bar 13, the actuation by means of the workpiece detection device 11 should not take place immediately. It is unfavorable to set a fixed delay time, because of this variations in the advancing speed of the conveyor belt 1 cannot be taken into account, and furthermore, faulty control occurs when the conveyor belt 1 stops. Consequently, the deflecting roller 4 is equipped with a pulse generator 15, the pulses of which are transmitted to the computer 10 which itself only needs to wait for the input of a predetermined number of pulses, in order to effect the control caused by means of the workpiece detection device 11. Of course, other means for measuring the transport speed are also possible.

Figure 2:
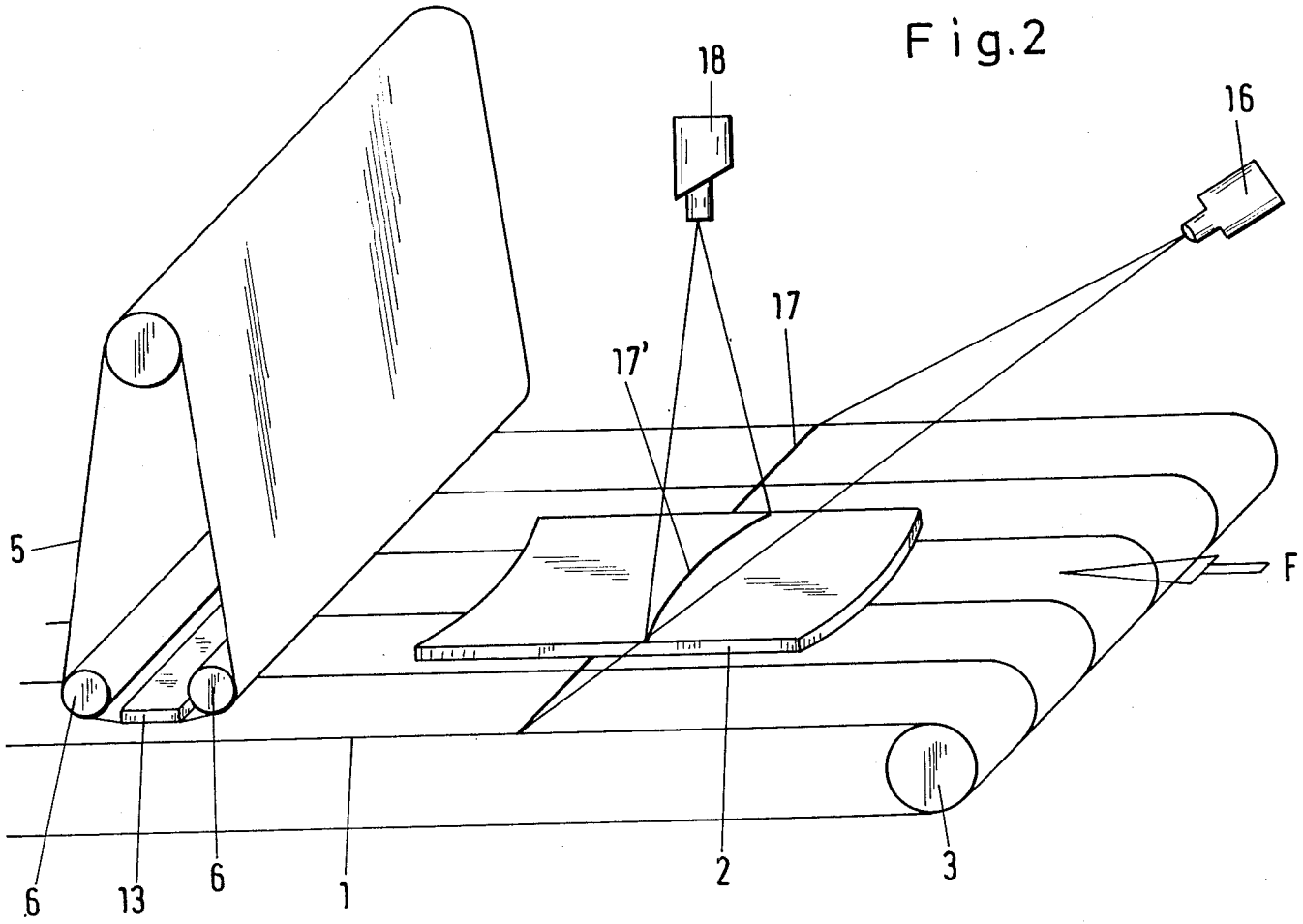
FIG. 2 shows an exemplary embodiment of a workpiece detection device according to the invention, in a perspective side view.

FIG. 2 illustrates an exemplary embodiment of a workpiece detection device 11 according to the invention. This comprises a light source 16, the light from which is of linear form and produces, on the transport plane formed by the upper face 1, a light mark 17 which is perpendicular to the conveying direction F. As a result of the workpiece which, in FIG. 2, is shown to have an approximately cylindrical shape on top, a bent light mark 17 is generated on the surface of the workpiece 2, is directed rearwards towards the longitudinal edges of the workpiece 2, and has a curve directed forwards in the conveying direction F. This curve is obtained because the light source 16 is arranged behind the workpiece in the conveying direction F, that is to say, beams light obliquely onto the workpiece 2. A semiconductor camera 18 acting as a light sensor detects the form of the bent light line 17′ by sensing the surface of the workpiece 2 essentially perpendicularly to the transport plane. As a result of the detection of the position of the light line 17′ in space, the computer 10 determines the local heights of the surface of the workpiece 2 and controls the belt grinding machine accordingly.

Figure 3:
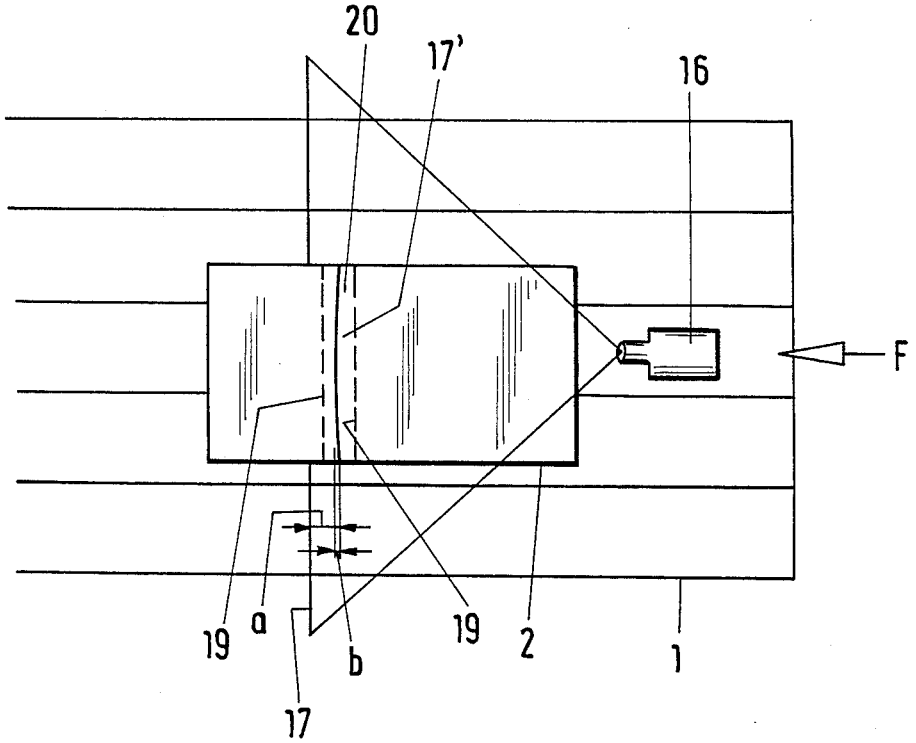
FIG. 3 shows a plan view of the illuminating arrangement of FIG. 2.

FIG. 3 shows a plan view from above of the formation of the light line 17 in the transport plane of the upper face 1 and of the bent light line 17′ on the surface of the workpiece 2. The broken lines 19 on both sides of the bent light line 18′ represent the limits of the region 20, which are sensed by the semiconductor camera 18. For this purpose, the semiconductor camera 18 can be equipped with image sensors in a two-dimensional arrangement, which can simultaneously scan the entire region 20 by means of its scanning elements and can be read off in series.

The distance a between the light line 17 and the foremost end of the bent light line 17′ provides a measure of the thickness of the workpiece 2, the ends of which are warped upwards, whilst the dimension b characterized the height of the lateral warps.

Figure 4:
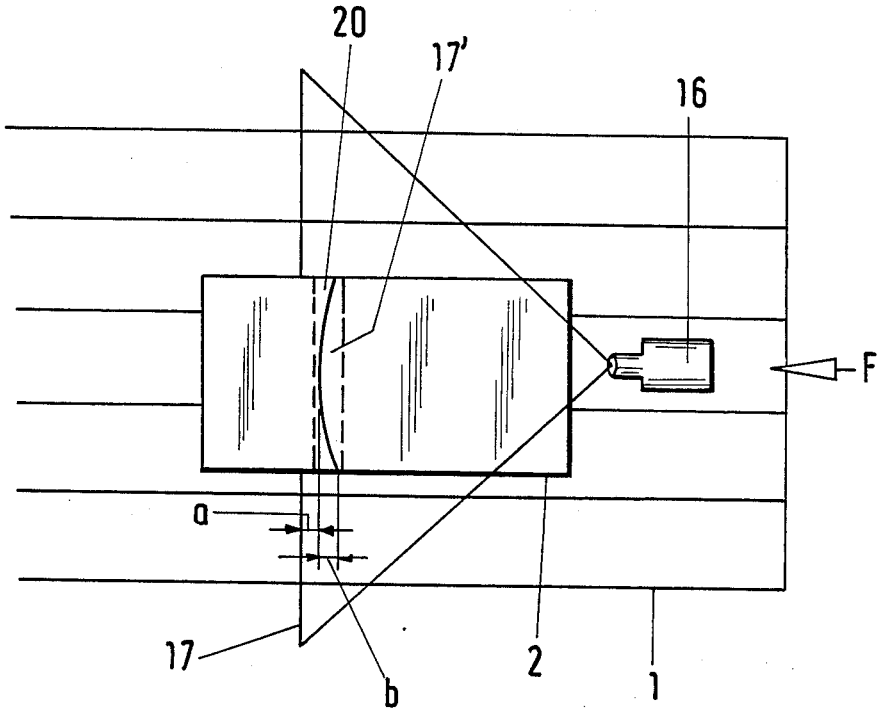
FIG. 4 shows a diagrammatic representation of the image field for the light sensor, in a region to be sensed which is extended in the conveying direction.

FIG. 4 shows diagrammatically the same situation as in FIG. 3, but with a picture in which the image of the region 20 to be sensed is stretched in the conveying direction F by means of a cylindrical lens or a cylindrical deflecting mirror. As is evident, the resolution in the relevant region 20 is increased substantially thereby, so that more accurate workpiece detection is possible.

Figure 5:
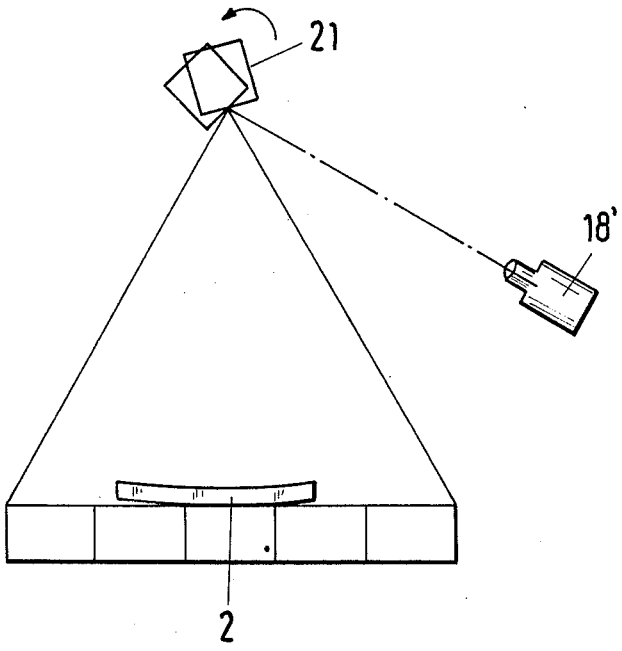
FIG. 5 shows a diagrammatic representation of the scan using a linear camera.

FIG. 5 shows diagrammatically the scan carried out by a semiconductor camera 18′ which has only photosensitive elements aligned linearly. These photosensitive elements arranged linearly are aligned in such a way that they scan the workpiece 2 in the conveying direction F, whilst the scan perpendicular to the conveying direction F is carried out by means of a rotating deflecting mirror 21. The electronic scan by means of the linearly arranged photosensitive elements of the semiconductor camera 18' takes place at a substantially higher speed than the scan perpendicular to the conveying direction F caused as a result of the mechanical movement of the deflecting mirror 21.

Figure 6:
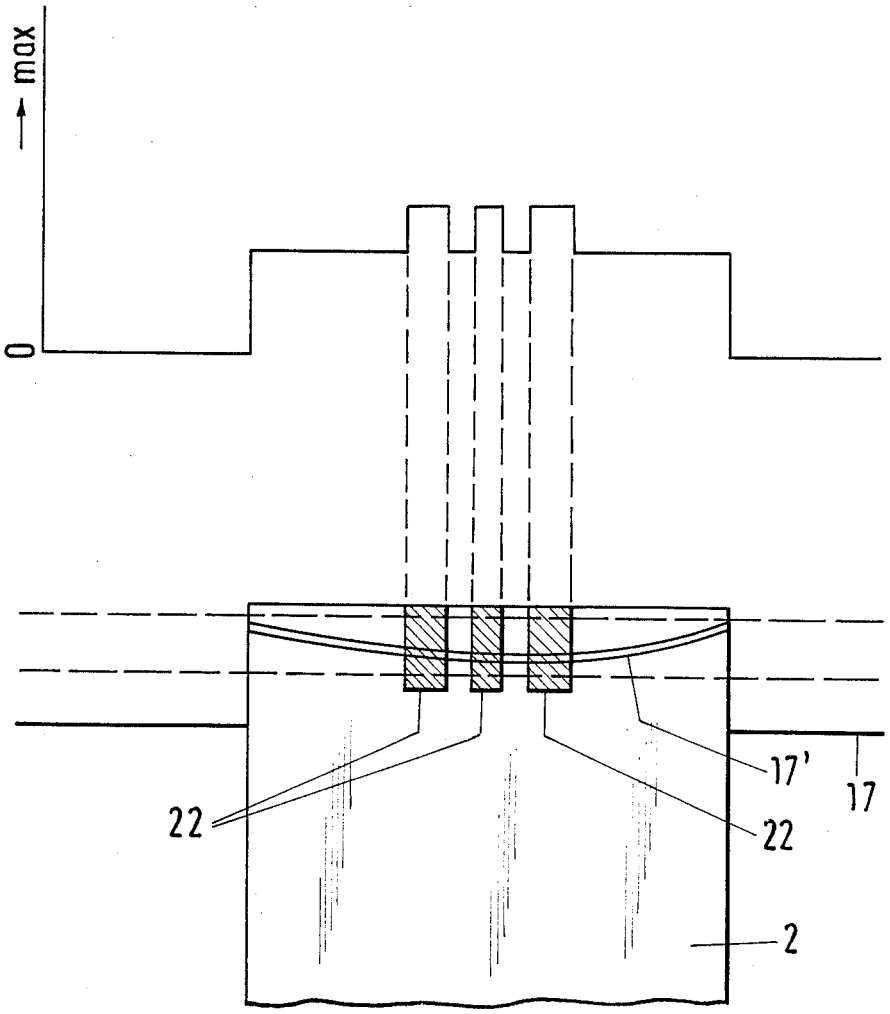
FIG. 6 shows an example of the sensing of a bar code, with the brightness distribution occurring thereby.

FIG. 6 illustrates an extremely advantageous use of the workpiece detection device 11 according to the invention. It shows the front end of a workpiece 2, on which the bent light line 17' is obtained, offset relative to the light line 17 in the transport plane, as a result of the shape of the surface of the workpiece 2. The front end of the workpiece 2 is provided with a bar code which is formed from three bars 22 of differing width, which does not change the shape of the bent light line 17', but during the scan, generates in the light sensor 18,18' a brightness curve which is also shown in FIG. 6. This brightness curve can be detected by a detection means as a characteristic of a specific surface material and can be used to control the belt grinding machine. Of course, with such a bar code 22 other parameters relevant to the grinding operation can also be coded and detected automatically during scanning by means of the light sensor 18,18'.

Figure 7:
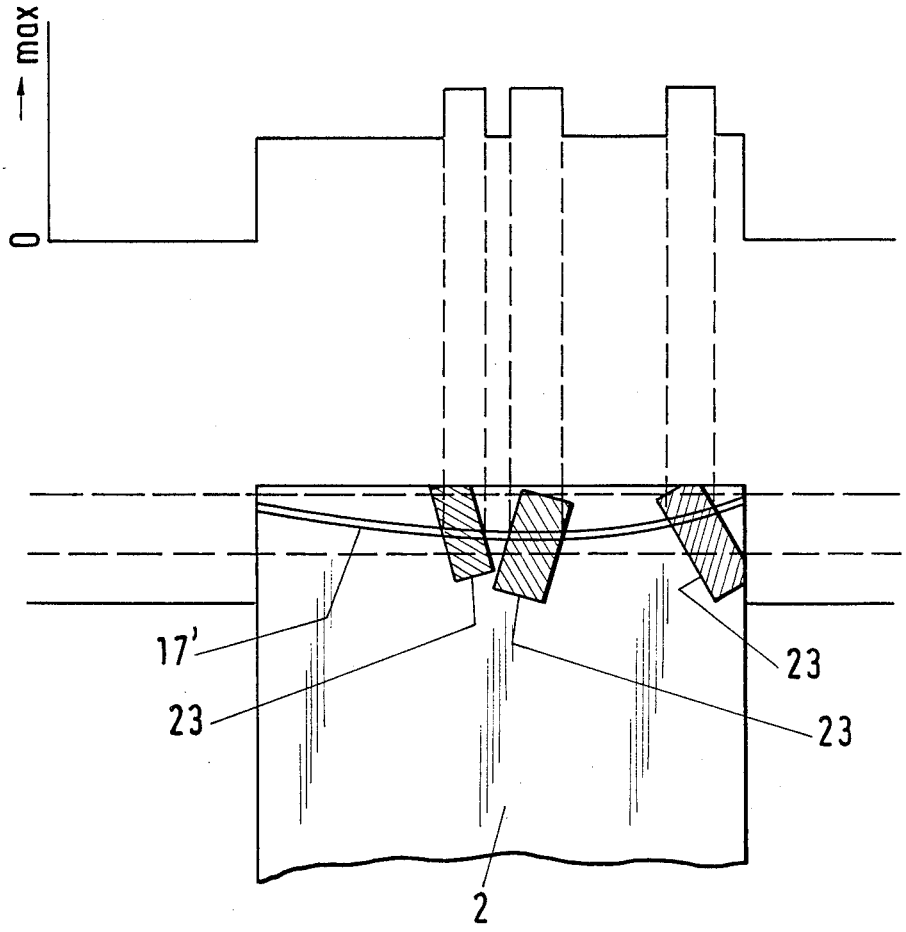
FIG. 7 shows an exemplary embodiment of the sensing of pieces of taping paper, with the associated brightness distribution being represented.

A similar use of the workpiece detection device according to the invention is shown in FIG. 7. A problem which has existed for a long time in the grinding of veneered wood boards is that, in order to fix the veneer strips, veneer tapes 23 glued as adhesive strips to the layers of veneer are used. These have to be removed completely during the grinding operation. Furthermore, the region located under them should likewise be ground carefully. The veneer tapes 23 have a toughness different from that of the surface material, so that they are often not removed completely during the grinding operation.

On the belt grinding machine, according to the invention, an especially high grinding pressure can be set for the veneer tapes 23, when the veneer tapes 23 as such are detected. This is possible directly if the veneer tapes 23 generate an especially high-contrast signal during illumination by the light line 17'. Where dark-colored veneered wood is concerned, this is ensured immediately by the use of white veneer tapes 23. For lighter woods, either black veneer tape 23 or reflecting veneer tape 23 can be used. If only a single-ply veneer tape 23 is used, there is virtually no offset of the light line 17' as a result of a change in height, because the veneer tape 23 has hardly any thickness. However, the light sensor 18,18' can detect a marked difference in brightness. Consequently, a detection means detecting contrast of this kind, that is to say, differences in brightness relative to the environment, makes it possible to detect the presence of veneer tape 23, so that the belt grinding machine can be controlled automatically in a suitable way in order to remove the veneer tape 23.

What is claimed is:

1. A belt grinding machine comprising a pressure bar which has a plurality of pressure shoes arranged next to one another transversely relative to the conveying direction of a workpiece to be machined, and in which each pressure shoe has assigned to it its own pressing-on device actuable as a function of workpiece parameters, a signal-processing unit means for controlling the pressing-on force of the pressing-on device based on the workpiece parameters, including the surface contour and thickness of the workpiece, and local and time data of the workpiece transport operation, a light source [for detecting workpiece parameters] that illuminates the surface of the workpiece linearly transversely relative to the conveying direction, wherein the light source is arranged in front of or behind a light incidence point in the conveying direction, and a light sensor which senses a surface region comprising a portion of the transverse direction and a portion in the conveying direction and outputs a signal to the signal-processing unit means that is used by the signal-processing unit means to determine the surface contour and thickness of the workpiece in the surface region.

2. A belt grinding machine as claimed in claim 1, wherein the light from the light source is widened linearly.

3. A belt grinding machine as claimed in claim 1, wherein the light source oscillates a light beam at a high frequency in a linear motion transverse to the conveying direction to form a constantly illuminated light strip on the surface of the workpiece.

4. A belt grinding machine as claimed in claim 1, wherein the light sensor comprises a semiconductor camera which, via an optical system, images the region to be sensed.

5. A belt grinding machine as claimed in claim 4, wherein the photosensitive elements of the semiconductor camera are arranged linearly to correspond to an image on the surface of the workpiece in the conveying direction, and further comprising a scanning mechanism that moves the image essentially perpendicularly relative to an extension of the photosensitive elements.

6. A belt grinding machine as claimed in claim 5, wherein the scanning mechanism comprises a deflecting mirror.

7. A belt grinding machine as claimed in claim 4, wherein the photosensitive elements of the semiconductor camera are in a two-dimensional arrangement.

8. A belt grinding machine as claimed in claim 4, wherein the semiconductor camera includes means for increasing the area of the region to be sensed in the conveying direction.

9. A belt grinding machine as claimed in claim 1, wherein the signal-processing unit means includes a detection means for detecting brightness variations in the signal output from the light sensor to the signal-processing unit means and determines the presence of taping papers on the surface of the workpiece based on the brightness variations.

10. belt grinding machine comprising a pressure bar which has a plurality of pressure shoes arranged next to one another transversely relative to the conveying direction of a workpiece to be machined, and in which each pressure shoe has assigned to it its own pressing-on device actuable as a function of workpiece parameters, a signal-processing unit means for controlling the pressing-on force of the pressing-on device based on the workpiece parameters and local and time data of the workpiece transport operation, a light source for detecting workpiece parameters that illuminates the surface of the workpiece linearly transversely relative to the conveying direction, wherein the light source is arranged in front of or behind a light incidence point in the conveying direction, and a light sensor which senses a surface region comprising a portion of the transverse direction and a portion in the conveying direction and outputs a signal to the signal-processing unit means that is used by the signal-processing unit means to determine the workpiece parameters, wherein the signal-processing unit means includes a detection means for detecting signal patterns which are obtained as a result of the sensing of a bar code, applied to the workpiece and extending transversely relative to the conveying direction, by means of the light sensor.

11. An apparatus comprising:

a. transport means for conveying a workpiece along a conveying path;

b. machining means for performing a machining operation on the workpiece as the workpiece is moved by the transport means past a machining point located along the conveying path;

c. detector means for generating an output signal indicative of the surface contour and thickness of the workpiece as the workpiece moves along the conveying path and before the workpiece reaches the machining point;

d. sensor means for generating an output signal indicative of the operation of the transport means; and e. control means for calculating the surface contour and thickness of the workpiece based on the output signal generated by the detector means, and for controlling the operation of the machining means based on the calculated surface contour and thickness and the output signal generated by the sensor means.

12. An apparatus as claimed in claim 11, wherein the detector means comprises a light source that generates a light beam perpendicular to the conveying path and at an angle oblique to the conveying path to form a light mark, and a light sensor that detects the shape of the light mark when the workpiece passes through the light beam as the workpiece moves along the conveying path.

13. An apparatus as claimed in claim 12, wherein the light sensor comprises a semiconductor camera having a linear photosensitive element.

14. An apparatus as claimed in claim 12, wherein the light sensor comprises a semiconductor camera having a two-dimensional array.

15. An apparatus as claimed in claim 17, wherein the light sensor includes at least one of a cylindrical lens and a cylindrical deflecting mirror that increases an imaging area of the sensor in the direction of the conveying path.

16. An apparatus as claimed in claim 11, wherein the signal generated by the detector means is also indicative of brightness variations caused by taping paper present on the surface of the workpiece, and the control means controls the operation of the machining means based on the brightness variations.

17. An apparatus as claimed in claim 11, wherein the machining means comprises a belt grinding machine including a pressure bar which has a plurality of pressure shoes arranged next to one another transversely relative to the conveying direction of a workpiece to be machined, and a plurality of independent actuable pressing-on devices corresponding to said plurality of pressure shoes.

18. An apparatus comprising:

a. transport means for conveying a workpiece along a conveying path;

b. machining means for performing a machining operation on the workpiece as the workpiece is moved by the transport means past a machining point located along the conveying path;

c. detector means for generating an output signal indicative of parameters of the workpiece as the workpiece moves along the conveying path and before the workpiece reaches the machining point;

d. sensor means for generating an output signal indicative of the operation of the transport means; and e. control means for calculating the parameters of the workpiece based on the output signal generated by the detector means, and for controlling the operation of the machining means based on the calculated parameters and the output signal generated by the sensor means;

wherein the signal generated by the detector means is also indicative of a brightness curve generated by a bar code placed on the surface of the workpiece, and the control means controls the operation of the machining means based on the brightness curve.

* * * * *